US006206983B1

(12) United States Patent
DeArdo et al.

(10) Patent No.: US 6,206,983 B1
(45) Date of Patent: Mar. 27, 2001

(54) MEDIUM CARBON STEELS AND LOW ALLOY STEELS WITH ENHANCED MACHINABILITY

(75) Inventors: Anthony J. DeArdo; C. Isaac Garcia, both of Pittsburgh, PA (US)

(73) Assignee: University of Pittsburgh - of the Commonwealth System of Higher Education, Pittsburgh, PA (US)

( * ) Notice: Subject to any disclaimer, the term of this patent is extended or adjusted under 35 U.S.C. 154(b) by 0 days.

(21) Appl. No.: 09/320,024

(22) Filed: May 26, 1999

(51) Int. Cl.[7] ..... C22C 38/60; C22C 38/16; C22C 38/00; C21D 6/00

(52) U.S. Cl. ..... 148/332; 148/320; 148/579; 148/660; 420/41; 420/89; 420/108; 420/129

(58) Field of Search ..... 420/89, 41, 129, 420/108, 8; 148/320, 332, 579, 660

(56) References Cited

U.S. PATENT DOCUMENTS

| | | | |
|---|---|---|---|
| 3,853,544 | 12/1974 | Nishi et al. | 75/125 |
| 3,973,950 | 8/1976 | Itoh et al. | 75/123 D |
| 4,247,326 | 1/1981 | Quinto et al. | 75/123 AA |
| 4,255,187 | 3/1981 | Bhattacharya et al. | 75/123 AA |
| 4,255,188 | 3/1981 | Riekels | 75/123 AA |
| 4,279,646 | 7/1981 | Kato et al. | 75/123 AA |
| 4,302,248 | 11/1981 | Kasamatsu et al. | 75/128 A |
| 4,394,168 | 7/1983 | Hartvig et al. | 75/126 A |
| 4,661,174 | 4/1987 | Miyoshi et al. | 148/111 |
| 4,670,065 | 6/1987 | Yasuda et al. | 148/2 |
| 4,719,079 | 1/1988 | Katayama et al. | 420/84 |
| 4,786,466 | 11/1988 | Holowaty | 420/84 |
| 4,806,304 | 2/1989 | Kimura et al. | 420/84 |
| 4,880,479 | 11/1989 | Birman et al. | 148/320 |
| 4,975,127 | 12/1990 | Kurosawa et al. | 148/111 |
| 5,102,479 | 4/1992 | Nakamura et al. | 148/333 |
| 5,125,991 | 6/1992 | Ishitobi et al. | 148/308 |
| 5,139,582 | 8/1992 | Kurosawa et al. | 148/111 |
| 5,173,128 | 12/1992 | Komatsubara et al. | 148/111 |
| 5,181,972 | 1/1993 | Komatsubara et al. | 148/111 |
| 5,213,633 | 5/1993 | Hada et al. | 148/334 |
| 5,244,511 | 9/1993 | Komatsubara et al. | 148/111 |
| 5,288,455 | 2/1994 | Siga et al. | 420/83 |
| 5,330,586 | 7/1994 | Komatsubara et al. | 148/111 |
| 5,360,676 | 11/1994 | Kuguminato et al. | 428/682 |
| 5,415,703 | 5/1995 | Ushigami et al. | 148/308 |
| 5,421,911 | 6/1995 | Schoen | 148/111 |
| 5,512,110 | 4/1996 | Yoshitomi et al. | 148/113 |
| 5,558,726 | 9/1996 | Yatoh et al. | 148/328 |
| 5,562,783 | 10/1996 | Inoue et al. | 148/310 |
| 5,645,794 | 7/1997 | Beguinot et al. | 420/106 |
| 5,665,178 | 9/1997 | Komatsubara et al. | 148/111 |
| 5,702,541 | 12/1997 | Inokuti | 148/308 |
| 5,718,775 | 2/1998 | Komatsubara et al. | 148/308 |
| 5,776,267 | 7/1998 | Nanba et al. | 148/328 |
| 5,807,441 | 9/1998 | Tomida et al. | 148/113 |
| 5,855,694 | 1/1999 | Toge et al. | 148/111 |
| 5,858,126 | 1/1999 | Takashima et al. | 148/308 |
| 5,885,374 | 3/1999 | Ishitobi et al. | 148/308 |
| 5,888,314 | 3/1999 | Ushigami et al. | 148/113 |

FOREIGN PATENT DOCUMENTS 56-84448 7/1981 (JP) .

OTHER PUBLICATIONS

H.J. Grabke, "Surface and Grain Segregation on and in Iron and Steels," *ISIJ International*, vol. 29, No. 7, pp. 529–538 (1989).

M.P. Seah, "Adsorption–Induced Interface Decohesion," *Acta Metallurgica*, vol. 28, pp. 955–962 (1980).

E.D. Hondros, "Interfacial Energies and Composition in solids," *Proceedings of TMS–AIME Heat Treatment Committee Symposium—Precipitation Processes In Solids*, Niagara Falls, New York, Sep. 20–21, 1976.

T.J. Baker, "Use of Scanning Electron Microscopy in Studying Sulphide Morphology on Fracture Surfaces," *Proceedings of an American Society of Metals International Symposium*, Port Chester, New York, Nov. 7–8, 1974.

ASTM Designation: A 29/A29M–93a, "Standard Specification for Steel Bars, Carbon and Alloy, Hot–Wrought and Cold–Finished, General Requirements For," Annual Book of ASTM Standards, Vol. 01.05, 1997, pp. 1–13.

Kazuaki Iwata, "The Effect of Lead on Crack Behavior of Leaded Free Machining Steel During Controlled Cutting Temperature Micro–Machining." Department of Mechanical Engineering, Kobe University, Rokko, Nada, Zkobe 657, Japan, 1976.

*Primary Examiner*—Deborah Yee
(74) *Attorney, Agent, or Firm*—Metz Schermer & Lewis, LLC; Leland P. Schermer; Thomas Lizzi

(57) ABSTRACT

The invention relates to medium carbon steels and low alloy steels having a concentration of a machinability enhancing agent ("MEA"), i.e. tin and/or antimony, at its ferrite grain boundaries which enhances the steel's machinability and to processes for producing such steels. The invention encompasses medium carbon steels and low alloy steels characterized by having MEA bulk contents of from about 0.02 to about 0.09 weight percent, by having the sum of the MEA bulk content and the copper bulk content being no greater than about 0.10 weight percent, and by having a microstructure at the time of machining having a concentration of MEA at ferrite grain boundaries in an amount at least about five times the MEA bulk content of the steel. The invention also encompasses processes for preparing medium carbon steels and low alloy steels with enhanced machinability comprising the steps of providing a steel containing a MEA, developing ferrite grain boundaries, and concentrating the MEA at the ferrite grain boundaries wherein the MEA bulk content of the steel is from about 0.02 to about 0.09 weight percent and the sum of the MEA bulk content and the copper bulk content being no greater than about 0.10 weight percent. The invention also encompasses processes further comprising the steps of machining the steel and of controllably redistributing the MEA more homogeneously throughout the steel so as to substantially remove any embrittlement resulting from the MEA concentration at the ferrite grain boundaries.

102 Claims, No Drawings

MEDIUM CARBON STEELS AND LOW ALLOY STEELS WITH ENHANCED MACHINABILITY

BACKGROUND OF THE INVENTION a) Field of the Invention

The present invention relates to medium carbon steels and low alloy steels and methods of making same. More specifically, the present invention relates to medium carbon steels and low alloy steels having a concentration of tin and/or antimony at the ferrite grain boundaries of the steel which enhances the machinability of the steel. The present invention also relates to processes for producing such steels.

b) Description of the Related Art

"Medium carbon steel" is a term used in the steelmaking art to refer to grades of steel that have carbon contents in the range of about 0.2 to about 0.4 weight percent. Likewise, the term "low alloy steel" refers to grades of steel having a carbon content in the range of about 0.1 to about 0.2 weight carbon and have alloy contents in the range of about 1to about 4 weight percent. These steels are often used in forgings, gears, and other parts for automotive and structural applications. Many of the parts made from these steels are machined at least once during their manufacture. Thus, the machinability of these steels is of great industrial importance.

Machinability, however, is a complex and not fully understood property. A full understanding of machinability would require taking into account a multitude of factors, including the effect of the steel composition, the elastic strain, plastic flow, and fracture mechanics of the metal workpiece, and the cutting dynamics that occur when steel is machined by cutting tools in such operations as turning, forming, milling, drilling, reaming, boring, shaving, and threading. Due to the complexities of the cutting process and the inherent difficulties in making real time observations at a microscopic level, knowledge of the extent of the range of mechanisms that affect machinability is also incomplete.

Lead is used to enhance the machinability of some grades of steel. However, the use of lead has serious drawbacks. Lead and lead oxides are hazardous. Caution must be taken during steelmaking and any other processing steps involving high temperatures. Such process steps produce lead and/or lead oxide fumes. Atmosphere control procedures must be incorporated into high temperature processing of lead-bearing steels. Disposal of the machining chips from lead-bearing free-machining steels is also problematic due to the lead content of the chips. Another serious disadvantage is that lead is not uniformly distributed throughout conventional steel products. This is because lead is not soluble in the steel and, due to its high density, it settles out during the teeming and solidification processes, resulting in segregation or non-uniform distribution within the steel. Furthermore, lead can envelope manganese sulfide inclusions in the steel thereby decreasing the steel's mechanical properties and service life through reduced resistance to impact and fatigue stresses.

Steels have also been developed in which machinability is enhanced through the use of inclusions in the steel. Manganese sulfide inclusions are often employed to promote machinability. Sometimes a soft phase, such as a low melting metal like bismuth or a plastic oxide, such as a complex oxide containing calcium, selenium or tellurium, is used to surround manganese sulfide inclusions to further enhance machinability. However, strategies that improve machinability through the use of inclusions have the disadvantage that the inclusions remain in the steel's microstructure after machining. The presence of inclusions in the steel may lower the steel's mechanical properties and lower its service life through reduced resistance to impact and fatigue stresses. Thus, although inclusions may be used as agents to improve machinability in some grades of steel, a price is paid in terms of reduced mechanical properties and service life.

SUMMARY OF THE INVENTION

The present invention improves the machinability of medium carbon steels and low alloy steels by concentrating tin and/or antimony at the ferrite grain boundaries of the steel in a manner in which the effects on the mechanical properties and service life of the steel caused by the agent used to improve machinability may be substantially removed after machining. For convenience sake, the term "machinability enhancing agent" or "MEA" will be used herein to refer to tin or antimony, either alone or in combination with each other, which is added to the steel to enhance the steel's machinability. The present invention permits the machinability enhancing effects of the MEA to be amplified through the use of thermal practices which act to concentrate the MEA at ferrite grain boundaries of the steel. Thus, the present invention uses only very low MEA bulk contents in the steel and thereby avoids the deleterious effects, such as hot tearing, associated with higher MEA bulk contents.

Concentration of MEAs at the ferrite grain boundaries in accordance with the present invention improves the machinability of medium carbon steels and low alloy steels by reducing the ferrite grain boundary strength and thereby reducing the energy required for metal removal during machining operations. However, the present invention also optionally allows any deleterious embrittling effects resulting from the MEA ferrite grain boundary concentrations to be substantially reversed through the use of subsequent thermal practices which act to redistribute the MEA more homogeneously throughout the steel. Such embrittling effects may manifest themselves in the form of reductions in ductility or impact toughness. Thus, the present invention permits the machinability of a low alloy steel to be improved through a first thermal practice and then through the use of an optional second thermal practice to controllably and substantially remove any deleterious embrittling effects resulting from the MEA ferrite grain boundary concentrations by redistributing the MEA more homogeneously throughout the steel. In other words, the present invention controllably enhances the machinability of low allow steel by reversibly concentrating MEA at the ferrite grain boundaries of the steel.

Thus, it is an object of the present invention to improve the machinability of medium carbon steels and low alloy steels.

It is another object of the present invention to improve the machinability of medium carbon steels and low alloy steels without the need to rely on the use of lead for enhancing machinability and thereby avoid disadvantages that accompany the use of lead.

It is another object of the present invention to provide a low alloy steel without the need to rely on the formation of a a soft phase surrounding sulfide inclusions, such as a low melting metal like lead or bismuth or a plastic oxide, such as a complex oxide containing calcium, selenium or tellurium to improve the machinability of medium carbon steels and low alloy steels.

Another object of the present invention is to provide medium carbon steels and low alloy steels in which enhanced machinability can be controllably induced into the steel prior to machining and then the enhancement can be controllably and substantially removed from the steel after machining.

Another object of the present invention is to controllably enhance the machinability of medium carbon steels and low allow steels containing a small bulk content of MEA by reversibly concentrating MEA at ferrite grain boundaries of the steel.

It is another object of the present invention to provide medium carbon steels and low alloy steels which can be machined into parts which are useful as machined steel parts.

It is another object of the present invention to provide processes of making medium carbon steels and low alloy steels which accomplish the foregoing objects. A further object of the present invention is to provide products produced by those processes.

The present invention accomplishes the foregoing objects by providing medium carbon steels and low alloy steels compositions having a concentration of MEA at ferrite grain boundaries to improve the machinability of the steels and by providing processes for making such steels.

The present invention encompasses medium carbon steels and low alloy steels which are characterized by having MEA bulk contents of from about 0.02 to about 0.09 weight percent, by having the sum of the MEA bulk content and the copper bulk content being no greater than about 0.10 weight percent, and by having a microstructure at the time of machining having a concentration of MEA at ferrite grain boundaries in an amount at least about five times the MEA bulk content of the steel.

The present invention also encompasses processes for preparing medium carbon steels and low alloy steels with enhanced machinability comprising the steps of providing a steel containing a MEA, developing ferrite grain boundaries in the steel, and concentrating the MEA at the ferrite grain boundaries wherein the MEA bulk content of the steel is from about 0.02 to about 0.09 weight percent and the sum of the MEA bulk content and the copper bulk content is no greater than about 0.10 weight percent. The present invention also encompasses processes further comprising the steps of machining the steel and of controllably redistributing the MEA more homogeneously throughout the steel. The latter step controllably and substantially removes any embrittlement resulting from the MEA concentration at the ferrite grain boundaries of the steel.

The present invention also includes free-machining steels which result as products of employing the processes embraced by the present invention.

These and other features, aspects and advantages of the present invention will become better understood with reference to the following definitions, descriptions of preferred embodiments, examples, and appended claims.

Definitions

As used herein, the following terms have the meaning described in this section, with the understanding that these meanings are not limited but instead embrace equivalents as understood by those skilled in the art.

1. Austenite-to-ferrite transformation temperature range.

The "austenite-to-ferrite transformation temperature range" for a steel is the temperature range in which, on cooling the steel, austenite may be transformed to ferrite and comprises temperatures from the steel's upper austenite transformation temperature, $A_{r3}$, through the steel's lower austenite transformation temperature, $A_{r1}$.

2. Austenite-to-ferrite lower transformation temperature, $A_{r1}$.

The "austenite-to-ferrite lower transformation temperature," $A_{r3}$, is the temperature at which, on cooling the steel, austenite is completely transformed to ferrite or ferrite plus cementite.

3. Austenite-to-ferrite upper transformation temperature, $A_{r3}$.

The "austenite-to-ferrite upper transformation temperature," $A_{r3}$, of a steel is the temperature at which, on cooling the steel, austenite begins to transform to ferrite.

4. Base composition.

The "base composition" of a medium carbon steel or a low alloy steel is the SAE composition for the particular steel without consideration of the addition of a machinability enhancer, e.g. an MEA.

5. B index.

The "B index" is a measurement value used to evaluate the machinability of a steel. Higher B index values indicate better machinability. The B index value of a steel is determined on the basis of a number of machining tests wherein the cutting speed is varied and the amount of material removal is determined for a fixed amount of cutting tool wear.

The method of measuring the B index value is as follows. For a selected cutting speed, a single-point end-mill using a standard high-speed steel cutting tool, a standard coolant, and a standard feed rate is used to cut the surface of a cylindrical test sample having a diameter of 50 millimeters. Cutting is continued until the tool piece exhibits 0.7 millimeter of flank wear. The volume of material removed from the test sample is measured. The test is then repeated using other cutting speeds. The results of the tests are plotted on a log-log graph with the material volume removed plotted on the ordinate and the cutting speed plotted on the abscissa. The graph contains a reference line which is logarithmically graduated with B index values. A best-fit line is drawn through the plotted test points and, if necessary, is extended, to cross the reference line. The intersection of this best-fit line drawn through the test points with the reference line gives the B index value for the test material.

The testing conditions used for determining B index values are described in greater detail in "The Volvo Standard Machinability Test," Std. 1018.712, The Volvo Laboratory for Manufacturing Research, Trollhattan, Sweden, 1989, which is incorporated herein by reference.

6. Bulk content.

The phrase "bulk content" refers to the overall amount in weight percent of the referenced substance present in the steel as would be determined by a chemical analysis of a bulk sample of the steel. For example, "MEA bulk content" refers to the overall amount of the MEA in the steel as would be determined by a chemical analysis of a bulk sample of the steel.

7. Concentration of MEA at ferrite grain boundaries.

The phrase "concentration of MEA at ferrite grain boundaries," and syntactic inflections of that phrase, refer to the amount of MEA that is located at the ferrite grain boundaries of the steel as measured by the technique described in the following paragraphs. It is important to the understanding of the present invention to distinguish between the MEA bulk content of the steel and the concentration of MEA at ferrite grain boundaries.

The concentration of MEA at ferrite grain boundaries can be measured in the following manner. A sample of the steel is electropolished into needle specimens using a solution of 25% perchloric acid in acetic acid floating upon carbon tetrachloride and a voltage of 15–20 volts DC. As the electropolishing progresses, the steel sample necks down at the interface between these two immiscible liquids until it finally breaks into two needle pieces. One of the needles is then sharpened by electropolishing using 2% perchloric acid in 2-butoxyethanol and a voltage of 10–15 volts DC. The needle is then examined with a transmission electron microscope to determine if a ferrite grain boundary is within 300 nanometers of the needle tip. If no ferrite grain boundary is within 300 nanometers of the end of the needle tip, then the needle sample is micro-electropolished using 2% perchloric acid in 2-butoxyethanol and a voltage of 10 volts DC, with the voltage being supplied by a pulse generator for which the time interval can be controlled on the order of milliseconds. The needle tip is again examined with transmission electron microscope. The cycle of micro-electropolishing and transmission electron microscope examination is continued until a ferrite grain boundary is within 300 nanometers of the end of the needle tip. The ferrite grain boundary is then examined in an Atom Probe Field Ion Microscope whereby a raw value of the concentration of the MEA, $C_R$, is measured. This raw value, $C_R$, is then multiplied by a correction factor, K, to obtain a corrected value of the concentration of MEA at ferrite grain boundaries, $C_C$. The correction factor, K, is the ratio of the observed ferrite grain boundary area to the aperture area of the Atom Probe Field Ion Microscope. That is, K is equal to the observed area of the ferrite grain boundary divided by the area of the field of observation of the Atom Probe Field Ion Microscope. Thus, $$K=A_{gb}/A_a=(1\times t)/(\pi\times r^2)$$

and $$C_C=K\times C_R$$

where,

K is the correction factor;

$A_{gb}$ is the observed area of the ferrite grain boundary visible in the field of observation;

$A_a$ is the area of the aperture of the Atom Probe Field Ion Microscope, that is, the area of the field of observation;

l is the length of the ferrite grain boundary visible in the field of observation;

t is the width of the ferrite grain boundary visible in the field of observation;

r is the radius of the field of observation;

$C_C$ is the corrected MEA concentration at ferrite grain boundaries; and $C_R$ is the raw value of the MEA concentration, within the area of the aperture that contains the ferrite grain boundary, measured by the Atom Probe Field Ion Microscope.

The above steps are repeated until a corrected value, $C_C$, is obtained for each of four to six ferrite grain boundaries of the steel. An average is then taken of all the corrected values thus obtained to determine the average MEA concentration at the ferrite grain boundaries of the steel. It is this average value that is referred to herein as the "concentration of MEA at ferrite grain boundaries."

8. Concentrate the MEA at the ferrite grain boundaries.

The phrase "concentrate the MEA at the ferrite grain boundaries," and syntactic inflections of that phrase, refer to subjecting a MEA-bearing steel to thermodynamic and kinetic conditions which result in MEA atoms becoming resident at the ferrite grain boundaries of the steel in significant numbers such that the amount of MEA at the ferrite grain boundaries exceeds the MEA bulk content in the steel. In other words, a step which concentrates the MEA at the ferrite grain boundaries results in a concentration of MEA at the ferrite grain boundaries that, as measured by the measurement technique described above, exceeds the MEA bulk content in the steel. The details of how such a step can be accomplished are provided later in this specification.

9. Equivalent diameter.

The concept of an "equivalent diameter" is employed to correlate heating or cooling times, temperatures, or rates for acquiring a particular metallurgical condition, as determined for a cylindrical sample of a metal, to a non-cylindrical sample of that metal. The phrase "equivalent diameter" refers to the diameter that would be possessed by a cylindrical sample, of the same metal as the non-cylindrical metal sample under consideration, that would acquire the same metallurgical condition as the non-cylindrical sample when subjected to the same heating or cooling conditions. Thus, the equivalent diameter of a given piece of steel would be the diameter had by the cylindrical sample that would correspond to that piece of steel for the purpose of determining the heating or cooling conditions necessary to arrive at a desired metallurgical condition in that piece of steel.

10. Ferrite-to-austenite upper transformation temperature, $A_{c3}$.

The "ferrite-to-austenite upper transformation temperature," $A_{c3}$, of a steel is the temperature at which, on heating, a steel ferrite is completely transformed to austenite.

11. Machinability enhancing agent ("MEA").

The phrase "machinability enhancing agent" or "MEA" refers to tin or antimony, either alone or in combination with each other.

12. Microalloyed derivative.

A "microalloyed derivative" of a named grade of steel is a steel which has been derived from the composition of the named grade through one or more small variations made to the composition of the named grade and may include small amounts on the order of 0.1 weight percent or less of additional elements not included in the composition of the named grade.

13. Reconcentrating the MEA at the ferrite grain boundaries.

The phrase "reconcentrating the MEA at the ferrite grain boundaries," and syntactic inflections of that phrase, refer to subjecting the steel, after the steel has been subjected to a process of redistributing the MEA in the steel, to thermodynamic and kinetic conditions, which are conducive to concentrating the MEA at the ferrite grain boundaries of the steel, for a sufficiently long time for the concentration of the MEA at the ferrite grain boundaries to increase.

14. Redistributing the MEA in the steel.

The phrase "redistributing the MEA in the steel," and syntactic inflections of that phrase, refer to subjecting the steel to thermodynamic and kinetic conditions, which are conducive to homogenizing the MEA distribution in the steel, for a sufficiently long time for the concentration of the MEA at the ferrite grain boundaries to diminish and then cooling the steel at a rate sufficiently fast to prevent the MEA from reconcentrating at the ferrite grain boundaries of the steel.

DETAILED DESCRIPTION OF PREFERRED EMBODIMENTS

Embodiments of the present invention include medium carbon steels and low alloy steels having concentrations of MEA at ferrite grain boundaries of the steel to enhance the steel's machinability. The steels in these embodiments are characterized by having MEA bulk contents of from about 0.02 to about 0.09 weight percent, by having the sum of the MEA bulk content and the copper bulk content being no greater than about 0.10 weight percent, and by having, at the time of machining, a concentration of MEA at ferrite grain boundaries in an amount at least about five times the MEA bulk content of the steel.

The present invention is preferably used in conjunction with steels having base compositions of all grades of normalized and tempered medium carbon steels and with all quenched and tempered low alloy steel forging grades. Examples of such grades, in terms of the grade designations promulgated by the Society for Automotive Engineers ("SAE") include, without limitation, SAE grades 1016, 1035, 1038, 1040, 1041, 1045, 1518, 1541, 3120, 4118, 4130, 4135, 4142, 4150, 4337, 4320, 4720, 5120, 5130, 5135, 8620, and 9315. It is to be understood that all references herein to any or all of the SAE grades listed in the previous sentence include the microalloyed derivatives of those grades.

The steels of the preferred embodiments of the present invention further include the addition to the base composition of MEA, i.e. tin or antimony, either alone or in combination with each other. The MEA bulk content in these embodiments is from about 0.02 to about 0.09 weight percent. MEA bulk contents of less than about 0.02 weight percent are insufficient to provide desirable levels of enhancement of the steel's machinability. MEA bulk contents of greater than about 0.09 weight percent undesirably increase the susceptibility of the steel to hot tearing during hot working.

Furthermore, because the present invention relies on selectively concentrating MEA at ferrite grain boundaries to improve the machinability of the steel, it is necessary to keep to a minimum elements which could diminish the capacity of the ferrite grain boundaries to accept the MEA atoms. An example of such an element is copper. Therefore, it is desirable in practicing the present invention that the bulk content of copper in the steel be kept as low as possible. Preferably, the copper bulk content in the steel is no greater than about 0.01 weight percent and more preferably no greater than about 0.008 weight percent. In preferred embodiments of the present invention, the combined weight percent of the bulk contents of MEA and copper is no greater than about 0.10.

In the present invention, some preferred versions of a process for preparing medium carbon steels and low alloy steels with enhanced machinability comprise the steps of providing a steel containing a MEA, developing ferrite grain boundaries in the steel, and concentrating the MEA at the ferrite grain boundaries wherein the MEA bulk content of the steel is from about 0.02 to about 0.09 weight percent and the sum of the MEA bulk content and the copper bulk content is no greater than about 0.10 weight percent. Although in different embodiments of the present invention these steps may be accomplished in a variety of ways, a number of preferred ways of accomplishing these steps will now be discussed.

The step of providing a medium carbon steel or a low alloy steel containing a MEA is preferably accomplished by producing, by conventional steelmaking methods, a molten steel having a composition of a medium carbon steel or a low alloy steel which includes a MEA bulk content of between about 0.02 and about 0.04 weight percent and in which the sum of the MEA bulk content and the copper bulk content is no greater than about 0.10 weight percent. Preferably the steel provided will have a composition of a normalized and tempered medium carbon steel grade or of a quenched and tempered alloy steel forging grade. Examples of such grades include, without limitation, SAE grades 1016, 1035, 1038, 1040, 1041, 1045, 1518, 1541, 3120, 4118, 4130, 4135, 4142, 4150, 4337, 4320, 4720, 5120, 5130, 5135, 8620, and 9315.

The step of developing the ferrite grain boundaries in the steel is accomplished by cooling the steel at a controlled cooling rate through the austenite-to-ferrite transformation temperature range. This step is preferably accomplished after the steel has been hot worked or heat treated but it is also within the contemplation of the present invention that this step be accomplished at other times; for example, during the cooling from the solidification of the steel. In order to accomplish this step, it is necessary that the cooling rate employed from the austenite range of the steel be not so fast that the formation of ferrite is avoided. The cooling rate is controlled through the austenite-to-ferrite transformation temperature range so that the microstructure of the steel, after cooling, will comprise ferrite and pearlite.

The step of concentrating the MEA at the ferrite grain boundaries may be accomplished in a number of ways. Two of the preferred ways of accomplishing this step will now be described.

One preferred way of concentrating the MEA at the ferrite grain boundaries is to cool the steel at a cooling rate slower than about 1° C. per second through the steel's austenite-to-ferrite transformation temperature range and down to about 400° C. In other words, the cooling rate in this preferred embodiment is slower than about 1° C. per second from the steel's austenite-to-ferrite upper transformation temperature, $A_{r3}$, through about 400° C. In this embodiment, the step of concentrating the MEA is conducted partly contemporaneously with the step of developing ferrite grain boundaries in the steel. The cooling may be performed following a subjection of the steel to high temperature such as occurs during solidification, heat treating, or hot working operations. Preferably, the cooling is performed after some hot working operation on the steel, such as hot rolling or hot forging, has been completed at temperatures above about the steel's upper austenite transformation temperature, $A_{r3}$. A preferred way of accomplishing the cooling is to cool the steel under insulation blankets or covers although air cooling or furnace cooling may also be employed depending on the cooling rate desired and on the physical dimensions of the steel.

Another preferred way of concentrating the MEA at the ferrite grain boundaries is to hold the steel in the temperature range of from about 425° C. to about 575° C. for a time sufficiently long to concentrate the MEA at the ferrite grain boundaries. Preferably, the hold time is at least about 0.4 hours per centimeter (1 hour per inch) of equivalent diameter of the steel. The hold time necessary for a given temperature exposure for a particular steel article can be determined by analyzing the amount of MEA at the ferrite grain boundaries in the manner specified above to determine whether the time was sufficiently long to concentrate the MEA at the ferrite grain boundaries. Alternatively, whether or not the hold time was sufficiently long for a given temperature exposure can be ascertained by determining if the machinability of the steel has reached the desired level.

What the described preferred ways of accomplishing the step of concentrating the MEA at the ferrite grain boundaries have in common is that they all subject the steel to thermodynamic and kinetic conditions which result in MEA atoms becoming resident at the ferrite grain boundaries in significant numbers so that the concentration of MEA at ferrite grain boundaries exceeds the MEA bulk content. In general, within the above specified temperature ranges, the amount MEA concentrated at the ferrite grain boundaries will asymptotically increase as exposure times increase. Thus, in the preferred versions of the present invention described above, the MEA concentration at the ferrite grain boundaries will asymptotically increase as the cooling rate through the austenitic transformation temperature range is decreased or as the hold time in the temperature range of from about 425° C. to about 575° C. is increased. Thus, it is possible to control the amount of concentration of the MEA at ferrite grain boundaries by controlling the amount of time the steel is exposed to these temperature ranges.

Preferably, the step of concentrating the MEA at the ferrite grain boundaries results in concentrating the MEA at the ferrite grain boundaries to a concentration which is at least about five times the bulk MEA content. For example, where the MEA bulk content in the steel is 0.05 weight percent, this step will result in MEA concentrations at the ferrite grain boundaries of at least about 0.25 weight percent.

Other preferred versions of a process for preparing medium carbon and low alloy steels in accordance with the present invention further comprise the steps of machining the steel and then redistributing the MEA in the steel. The step of redistributing the MEA in the steel substantially reverses any deleterious embrittling effects resulting from the MEA ferrite grain boundary concentrations. Although in different embodiments of the present invention these steps may be accomplished in a variety of ways, a number of preferred ways of accomplishing some of these steps will now be discussed.

The step of machining may be accomplished by any means of machining steel known to those skilled in the art. These means include, but are not limited to, such machining operations as turning, forming, milling, drilling, reaming, boring, shaving, and threading. It is not necessary that all of the machining that is to be done to the steel be accomplished during this machining step. For example, additional machining may be conducted on the steel after the MEA redistribution step has produced a partial or complete redistribution of the MEA in the steel.

The step of redistributing the MEA in the steel comprises subjecting the steel to thermodynamic and kinetic conditions, which are conducive to homogenizing the MEA distribution in the steel, for a sufficiently long time for the concentration of the MEA at the ferrite grain boundaries to diminish or the ferrite grain boundaries to be eliminated and then cooling the steel at a rate sufficiently fast to prevent the MEA from reconcentrating at the ferrite grain boundaries. The purpose of this step is to controllably eliminate, either partially or completely, any embrittling effects which resulted from concentrating the MEA at the ferrite grain boundaries. Such embrittling effects may be manifested by reduced ductility or impact toughness. Optimally, the thermodynamic and kinetic conditions are maintained until the concentration of the MEA at the ferrite grain boundaries is substantially the same as the MEA bulk content. This optimal way of practicing this step results in the most thorough removal of the embrittlement, and, consequentially, in the most complete restoration of the ductility and/or toughness of the steel. However, it is not necessary for the practice of those versions of the present invention in which the step of redistributing the MEA is employed that the redistribution of the MEA be taken to this optimal condition. For example, under circumstances when some improvement in ductility is desired for the service application of the steel but some additional machining operations are anticipated after the MEA redistribution step, it may be beneficial to controllably redistribute the MEA only partially so as to retain a portion of the machinability-enhancement while regaining sufficient ductility for the steel to perform properly in service.

A preferred way of accomplishing the step of redistributing the MEA in the steel is to heat the steel to a temperature above the steel's ferrite-to-austenite upper transformation temperature, $A_{c3}$, for at least 0.4 hours per centimeter (1 hour per inch) of equivalent diameter of the steel and then to cool the steel at a rate faster than 1° C. per second through the steel's austenite-to-ferrite transformation temperature range and down to about 400° C. This cooling rate avoids a reconcentration of the MEA at the ferrite grain boundaries.

Advantageously, the redistribution of the MEA may be accomplished during an existing post-machining process, e.g. carburization, so long as the steel is held in the steel's austenite region sufficiently long to redistribute the MEA more homogeneously into the steel and the cooling rate is sufficiently fast to avoid the reconcentration of the MEA at ferrite grain boundaries of the steel.

The various thermal practices referred to in the above discussion may be conducted by any means known to those skilled in the art. For example, all or part of such thermal practices may be conducted in refractory-lined, temperature-controlled furnaces which are heated electrically or through the combustion of a fuel. The cooling rates discussed may be accomplished in any manner known to those skilled in the art by which cooling temperatures and times can be controlled. For example, the cooling rates may be achieved by use of furnace cooling or by surrounding the hot steel with insulation materials during cooling. In some preferred versions of the process of the present invention, insulation blankets are placed over the steel at the conclusion of the hot rolling or hot forging process to control the cooling rate.

An embodiment of a process of the present invention employing the steps of machining and redistributing the MEA will now be described in the manufacture of articles such as a simple machine part, a shaft, a crankshaft, or a pinion. In this embodiment, an addition of an MEA is made to a medium carbon steel or a low alloy steel by conventional methods during conventional steelmaking operations. The bulk content of MEA in the steel is in the range of about 0.02 to about 0.09 and the copper bulk content is maintained at a low level so that the sum of the bulk contents of the MEA and the copper is no greater than about 0. 10. The steel is then continuously cast into slabs or billets. The slabs or billets are hot rolled into bar. The as-hot rolled bars are shipped to a forging shop for the forging of the bars into a forged preform which subsequently will be machined into a machined article. At the forging shop, an as-hot rolled bar is reheated to about 1100–1300° C., i.e a temperature that is well within the steel's austenite temperature region. The bar is then hot forged into a forged preform and air cooled from the austenite temperature range to room temperature. The air cooling is conducted in a manner so that the cooling rate of the steel slower than about 1° C. per second through the austenite-to-ferrite transformation temperature range and down to about 400° C. The cooling rate allows ferrite grains to form and MEA to concentrate at the ferrite grain boundaries to levels of at least about five times the MEA bulk content. The forged preform is then machined into a machined article. The machined article is then reheated into the steel's austenite temperature region to reaustenitize the steel. This step has the effect of redistributing the MEA more homogeneously throughout the steel. The reheating is followed by a rapid quenching into a medium such as water, oil, polymer, brine, or a fused salt to room temperature or at least to a temperature below about 400° C. This rapid quenching at a rate faster than 1° C. per second through the steel's austenite-to-ferrite transformation temperature range and to below about 400° C. prevents the MEA from reconcentrating at the ferrite grain boundaries and may also avoid the formation of ferrite grain boundaries.

EXAMPLE

Three laboratory heats of steel with base compositions of SAE grade 8620 steel were made by conventional methods. Additions of inclusion-type machinability enhancers were made to the two of the heats. One of those two heats receiving an inclusion-type machinability enhancer also received an addition of the MEA tin according to an embodiment of the present invention.

The compositions of the heats are given in TABLE I. Steel 1 is the standard base SAE 8620 steel. Steel 2 has an addition of the inclusion type machinability enhancer calcium. Steel 3 contains calcium but it also includes an addition of the MEA tin according to the present invention at a bulk content of 0.025 weight percent.

TABLE 1

Chemical Composition of steels (wt %)

| Steel | C | Mn | P | S | Si | Cr | Ni | $O_2$ | Mo | Al | Ca | Sn |
|---|---|---|---|---|---|---|---|---|---|---|---|---|
| 1 | .22 | .83 | .016 | .026 | .22 | .50 | .43 | .002 | .19 | .029 | — | — |
| 2 | .20 | .90 | .020 | .047 | .25 | .50 | .50 | .004 | .20 | .017 | .003 | — |
| 3 | .20 | .90 | .020 | .040 | .25 | .50 | .50 | .004 | .20 | .020 | .003 | .025 |

The steels were hot rolled in the austenite temperature range from ingots into 5 cm diameter bars using standard procedures and then air cooled from the austenite temperature range at a cooling rate of about 0.4° C. per sec. The machinability of the three steels was then evaluated using the Volvo standard machinability test method. The Volvo standard machinability test method is described above in the Definition section as part of the entry for "B index." The results of the machinability test appear below in TABLE 2.

TABLE 2

Machinability index (B-index)

| Steel | B-index |
|---|---|
| SAE 8620 | 28 |
| 8620 + Ca | 62 |
| 8620 + Sn | 70 |

These results show that the machinability of steel 3, which was processed in accordance with an embodiment of the present invention, was superior to that of the of steel 2 which contained only the inclusion-type machinability enhancer. The results also show that the machinability of steel 3 was far superior to that of the base grade sample, i.e. steel 1. A measurement of the grain boundary concentration of tin in steel 1 revealed that the MEA tin was present at the ferrite grain boundaries at a level six times greater than that of the tin bulk content of the steel.

While only a few embodiments and versions of the present invention have been shown and described, it will be obvious to those skilled in the art that many changes and modifications may be made thereunto without departing from the spirit and scope of the present invention. Therefore, it is to be distinctly understood, that the present invention is not limited to the specific embodiments and versions described herein but may be otherwise embodied and practiced within the scope of the following claims.

We claim:

1. Medium carbon steels and low alloy steels comprising:

a) a machinability enhancing agent bulk content of from about 0.02 to about 0.09 weight percent;

b) a sum of the machinability enhancing agent bulk content and a copper bulk content of no greater than about 0.10 weight percent; and c) a microstructure having a concentration of machinability enhancing agent at ferrite grain boundaries in an amount of at least about five times the machinability enhancing agent bulk content.

2. The medium carbon steels and low alloy steels described in claim 1 wherein the medium carbon steels and low alloy steels have a base composition selected from the group consisting of SAE grade 1016, 1035, 1038, 1040, 1041, 1045, 1518, 1541,3120,4118, 4130, 4135, 4142, 4150, 4337,4320, 4720, 5120, 5130, 5135, 8620, and 9315.

3. A medium carbon steel described in claim 1 wherein the steel has a base composition of a normalized and tempered medium carbon steel grade.

4. A low alloy steel described in claim 1 wherein the steel has a base composition of a quench and tempered low alloy steel grade.

5. Medium carbon steels and low alloy steels comprising:

a) a tin bulk content of from about 0.02 to about 0.09 weight percent;

b) a sum of the tin bulk content and a copper bulk content of no greater than about 0.10 weight percent; and c) a microstructure having a concentration of tin at ferrite grain boundaries in an amount of at least about five times the tin bulk content.

6. The medium carbon steels and low alloy steels described in claim 5 wherein the medium carbon steels and low alloy steels have a base composition selected from the group consisting of SAE grade 1016, 1035, 1038, 1040, 1041, 1045, 1518, 1541, 3120, 4118, 4130, 4135, 4142, 4150, 4337,4320, 4720, 5120, 5130, 5135, 8620, and 9315.

7. A medium carbon steel described in claim 5 wherein the steel has a base composition of a normalized and tempered medium carbon steel grade.

8. A low alloy steel described in claim 5 wherein the steel has a base composition of a quench and tempered low alloy steel grade.

9. Medium carbon steels and low alloy steels comprising:

a) an antimony bulk content of from about 0.02 to about 0.09 weight percent;

b) a sum of the antimony bulk content and a copper bulk content of no greater than about 0.10 weight percent; and c) a microstructure having a concentration of antimony at ferrite grain boundaries in an amount of at least about five times the antimony bulk content.

10. The medium carbon steels and low alloy steels described in claim 9 wherein the medium carbon steels and low alloy steels have a base composition selected from the group consisting of SAE grade 1016, 1035, 1038, 1040, 1041, 1045, 1518, 1541, 3120, 4118, 4130, 4135, 4142, 4150, 4337,4320, 4720, 5120, 5130, 5135, 8620, and 9315.

11. A medium carbon steel described in claim 9 wherein the steel has a base composition of a normalized and tempered medium carbon steel grade.

12. A low alloy steel described in claim 9 wherein the steel has a base composition of a quench and tempered low alloy steel grade.

13. A process for preparing medium carbon steels and low alloy steels, the method comprising the steps of:

a) providing a steel containing MEA;

b) developing ferrite grain boundaries in the steel; and c) concentrating the MEA at the ferrite grain boundaries;

wherein the MEA bulk content of the steel is from about 0.02 to about 0.09 weight percent and the sum of the MEA bulk content and the copper bulk content is no greater than about 0.10 weight percent.

14. The process described in claim 13 wherein the step of providing a steel containing MEA includes selecting a base composition of the steel from the group consisting of SAE grade 1016, 1035, 1038, 1040,1041, 1045, 1518, 1541, 3120, 4118, 4130, 4135, 4142, 4150, 4337, 4320, 4720, 5120, 5130, 5135, 8620, and 9315.

15. The process described in claim 13 wherein the step of providing a steel containing MEA includes providing the steel with a base composition of a normalized and tempered medium carbon steel grade.

16. The process described in claim 13 wherein the step of providing a steel containing MEA includes providing the steel with a base composition of a quench and tempered low alloy steel grade.

17. The process described in claim 13 wherein the step of concentrating the MEA at the ferrite grain boundaries includes cooling the steel at a cooling rate slower than about 1° C. per second from the steel's austenite-to-ferrite upper transformation temperature, $A_{r3}$, through about 400° C. to concentrate the MEA at the ferrite grain boundaries.

18. The process described in claim 13 wherein the step of concentrating the MEA at the ferrite grain boundaries includes holding the steel in a temperature range of from about 425° C. to about 575° C. for a time sufficiently long to concentrate the MEA at the ferrite grain boundaries.

19. The process described in claim 18 wherein the time of holding the steel in the temperature range of from about 425° C. to about 575° C. is at least about 0.4 hours per centimeter of equivalent diameter of the steel.

20. The process described in claim 13 further comprising the steps of:

a) machining the steel; and b) redistributing the MEA more homogeneously throughout the steel.

21. The process described in claim 20 wherein the step of redistributing the MEA in the steel comprises the steps of:

a) subjecting the steel to a temperature exceeding the ferrite-to-austenite upper transformation temperature, $A_{c3}$, of the steel for at least about 0.4 hours per centimeter of equivalent diameter; and b) cooling the steel at a rate faster than about 1° C. per second from the steel's austenite-to-ferrite upper transformation temperature, $A_{r3}$, through about 400° C. to avoid reconcentrating the MEA at the ferrite grain boundaries.

22. The process described in claim 20 wherein the step of providing a steel containing MEA includes selecting a base composition of the steel from the group consisting of SAE grade 1016, 1035, 1038, 1040, 1041, 1045, 1518, 1541, 3120, 4118, 4130, 4135, 4142, 4150, 4337, 4320, 4720, 5120, 5130, 5135, 8620, and 9315.

23. The process described in claim 20 wherein the step of providing a steel containing MEA includes providing the steel with a base composition of a normalized and tempered medium carbon steel grade.

24. The process described in claim 20 wherein the step of providing a steel containing MEA includes providing the steel with a base composition of a quench and tempered low alloy steel grade.

25. The process described in claim 20 wherein the step of concentrating the MEA at the ferrite grain boundaries includes cooling the steel at a cooling rate slower than about 1° C. per second from the steel's austenite-to-ferrite upper transformation temperature, $A_{r3}$, through about 400° C. to concentrate the MEA at the ferrite grain boundaries.

26. The process described in claim 20 wherein the step of concentrating the MEA at the ferrite grain boundaries includes holding the steel in a temperature range of from about 425° C. to about 575° C. for a time sufficiently long to concentrate the MEA at the ferrite grain boundaries.

27. The process described in claim 26 wherein the time of holding the steel in the temperature range of from about 425° C. to about 575° C. is at least about 0.4 hours per centimeter of equivalent diameter of the steel.

28. A process for preparing medium carbon steels and low alloy steels, the method comprising the steps of:

a) providing a steel containing tin;

b) developing ferrite grain boundaries in the steel; and c) concentrating the tin at the ferrite grain boundaries;

wherein the tin bulk content of the steel is from about 0.02 to about 0.09 weight percent and the sum of the tin bulk content and the copper bulk content is no greater than about 0.10 weight percent.

29. The process described in claim 28 wherein the step of providing a steel containing tin includes selecting a base composition of the steel from the group consisting of SAE grade 1016, 1035, 1038, 1040, 1041, 1045, 1518, 1541, 3120, 4118, 4130, 4135, 4142, 4150, 4337, 4320, 4720, 5120, 5130, 5135, 8620, and 9315.

30. The process described in claim 28 wherein the step of providing a steel containing tin includes providing the steel with a base composition of a normalized and tempered medium carbon steel grade.

31. The process described in claim 28 wherein the step of providing a steel containing tin includes providing the steel with a base composition of a quench and tempered low alloy steel grade.

32. The process described in claim 28 wherein the step of concentrating the tin at the ferrite grain boundaries includes cooling the steel at a cooling rate slower than about 1° C. per second from the steel's austenite-to-ferrite upper transformation temperature, $A_{r3}$, through about 400° C. to concentrate the tin at the ferrite grain boundaries.

33. The process described in claim 28 wherein the step of concentrating the tin at the ferrite grain boundaries includes holding the steel in a temperature range of from about 425° C. to about 575° C. for a time sufficiently long to concentrate the tin at the ferrite grain boundaries.

34. The process described in claim 33 wherein the time of holding the steel in the temperature range of from about 425°

C. to about 575° C. is at least about 0.4 hours per centimeter of equivalent diameter of the steel.

35. The process described in claim 28 further comprising the steps of:

a) machining the steel; and b) redistributing the tin more homogeneously throughout the steel.

36. The process described in claim 35 wherein the step of redistributing the tin in the steel comprises the steps of:

a) subjecting the steel to a temperature exceeding the ferrite-to-austenite upper transformation temperature, $A_{c3}$, of the steel for at least about 0.4 hours per centimeter of equivalent diameter; and b) cooling the steel at a rate faster than about 1° C. per second from the steel's austenite-to-ferrite upper transformation temperature, $A_{r3}$, through about 400° C. to avoid reconcentrating the tin at the ferrite grain boundaries.

37. The process described in claim 35 wherein the step of providing a steel containing tin 25 includes selecting a base composition of the steel from the group consisting of SAE grade 1016, 1035, 1038, 1040, 1041, 1045, 1518, 1541, 3120, 4118, 4130, 4135, 4142, 4150, 4337, 4320, 4720, 5120, 5130, 5135, 8620, and 9315.

38. The process described in claim 35 wherein the step of providing a steel containing tin includes providing the steel with a base composition of a normalized and tempered medium carbon steel grade.

39. The process described in claim 35 wherein the step of providing a steel containing tin includes providing the steel with a base composition of a quench and tempered low alloy steel grade.

40. The process described in claim 35 wherein the step of concentrating the tin at the ferrite grain boundaries includes cooling the steel at a cooling rate slower than about 1° C. per second from the steel's austenite-to-ferrite upper transformation temperature, $A_{r3}$, through about 400° C. to concentrate the tin at the ferrite grain boundaries.

41. The process described in claim 35 wherein the step of concentrating the tin at the ferrite grain boundaries includes holding the steel in a temperature range of from about 425° C. to about 575° C. for a time sufficiently long to concentrate the tin at the ferrite grain boundaries.

42. The process described in claim 41 wherein the time of holding the steel in the temperature range of from about 425° C. to about 575° C. is at least about 0.4 hours per centimeter of equivalent diameter of the steel.

43. A process for preparing medium carbon steels and low alloy steels, the method comprising the steps of:

a) providing a steel containing antimony;

b) developing ferrite grain boundaries in the steel; and c) concentrating the antimony at the ferrite grain boundaries;

wherein the antimony bulk content of the steel is from about 0.02 to about 0.09 weight percent and the sum of the antimony bulk content and the copper bulk content is no greater than about 0.10 weight percent.

44. The process described in claim 43 wherein the step of providing a steel containing antimony includes selecting a base composition of the steel from the group consisting of SAE grade 1016, 1035, 1038, 1040, 1041, 1045, 1518, 1541, 3120, 4118, 4130, 4135, 4142, 4150, 4337, 4320, 4720, 5120, 5130, 5135, 8620, and 9315.

45. The process described in claim 43 wherein the step of providing a steel containing antimony includes providing the steel with a base composition of a normalized and tempered medium carbon steel grade.

46. The process described in claim 43 wherein the step of providing a steel containing antimony includes providing the steel with a base composition of a quench and tempered low alloy steel grade.

47. The process described in claim 43 wherein the step of concentrating the antimony at the ferrite grain boundaries includes cooling the steel at a cooling rate slower than about 1° C. per second from the steel's austenite-to-ferrite upper transformation temperature, $A_{r3}$, through about 400° C. to concentrate the antimony at the ferrite grain boundaries.

48. The process described in claim 43 wherein the step of concentrating the antimony at the ferrite grain boundaries includes holding the steel in a temperature range of from about 425° C. to about 575° C. for a time sufficiently long to concentrate the antimony at the ferrite grain boundaries.

49. The process described in claim 48 wherein the time of holding the steel in the temperature range of from about 425° C. to about 575° C. is at least about 0.4 hours per centimeter of equivalent diameter of the steel.

50. The process described in claim 43 further comprising the steps of:

a) machining the steel; and b) redistributing the antimony more homogeneously throughout the steel.

51. The process described in claim 50 wherein the step of redistributing the antimony in the steel comprises the steps of:

a) subjecting the steel to a temperature exceeding the ferrite-to-austenite upper transformation temperature, $A_{c3}$, of the steel for at least about 0.4 hours per centimeter of equivalent diameter; and b) cooling the steel at a rate faster than about 1° C. per second from the steel's austenite-to-ferrite upper transformation temperature, $A_{r3}$, through about 400° C. to avoid reconcentrating the antimony at the ferrite grain boundaries.

52. The process described in claim 50 wherein the step of providing a steel containing antimony includes selecting a base composition of the steel from the group consisting of SAE grade 1016, 1035, 1038, 1040, 1041, 1045, 1518, 1541, 3120, 4118, 4130, 4135, 4142, 4150, 4337, 4320, 4720, 5120, 5130, 5135, 8620, and 9315.

53. The process described in claim 50 wherein the step of providing a steel containing antimony includes providing the steel with a base composition of a normalized and tempered medium carbon steel grade.

54. The process described in claim 50 wherein the step of providing a steel containing antimony includes providing the steel with a base composition of a quench and tempered low alloy steel grade.

55. The process described in claim 50 wherein the step of concentrating the antimony at the ferrite grain boundaries includes cooling the steel at a cooling rate slower than about 1° C. per second from the steel's austenite-to-ferrite upper transformation temperature, $A_{r3}$, through about 400° C. to concentrate the antimony at the ferrite grain boundaries.

56. The process described in claim 50 wherein the step of concentrating the antimony at the ferrite grain boundaries includes holding the steel in a temperature range of from about 425° C. to about 575° C. for a time sufficiently long to concentrate the antimony at the ferrite grain boundaries.

57. The process described in claim 56 wherein the time of holding the steel in the temperature range of from about 425° C. to about 575° C. is at least about 0.4 hours per centimeter of equivalent diameter of the steel.

58. A steel produced by the process described in claim 13.

59. A steel produced by the process described in claim 14.

60. A steel produced by the process described in claim 15.
61. A steel produced by the process described in claim 16.
62. A steel produced by the process described in claim 17.
63. A steel produced by the process described in claim 18.
64. A steel produced by the process described in claim 19.
65. A steel produced by the process described in claim 20.
66. A steel produced by the process described in claim 21.
67. A steel produced by the process described in claim 22.
68. A steel produced by the process described in claim 23.
69. A steel produced by the process described in claim 24.
70. A steel produced by the process described in claim 25.
71. A steel produced by the process described in claim 26.
72. A steel produced by the process described in claim 27.
73. A steel produced by the process described in claim 28.
74. A steel produced by the process described in claim 29.
75. A steel produced by the process described in claim 30.
76. A steel produced by the process described in claim 31.
77. A steel produced by the process described in claim 32.
78. A steel produced by the process described in claim 33.
79. A steel produced by the process described in claim 34.
80. A steel produced by the process described in claim 35.
81. A steel produced by the process described in claim 36.
82. A steel produced by the process described in claim 37.
83. A steel produced by the process described in claim 38.
84. A steel produced by the process described in claim 39.
85. A steel produced by the process described in claim 40.
86. A steel produced by the process described in claim 41.
87. A steel produced by the process described in claim 42.
88. A steel produced by the process described in claim 43.
89. A steel produced by the process described in claim 44.
90. A steel produced by the process described in claim 45.
91. A steel produced by the process described in claim 46.
92. A steel produced by the process described in claim 47.
93. A steel produced by the process described in claim 48.
94. A steel produced by the process described in claim 49.
95. A steel produced by the process described in claim 51.
96. A steel produced by the process described in claim 52.
97. A steel produced by the process described in claim 52.
98. A steel produced by the process described in claim 53.
99. A steel produced by the process described in claim 54.
100. A steel produced by the process described in claim 55.
101. A steel produced by the process described in claim 56.
102. A steel produced by the process described in claim 57.

* * * * *

UNITED STATES PATENT AND TRADEMARK OFFICE

CERTIFICATE OF CORRECTION

PATENT NO. : 6,206,983 B1
DATED : March 27, 2001
INVENTOR(S) : Anhony J. DeArdo and C. Isaac Garcia It is certified that error appears in the above-identified patent and that said Letters Patent is hereby corrected as shown below:

Column 1,
Line 20, "1to" should read -- 1 to --.

Column 2,
Line 61, "a a soft phase" should read -- a soft phase --.

Column 4,
Line 4, "$A_{r3}$" should read -- $A_{r1}$ --.

Column 10,
Line 53, "i.e" should read -- i.e., --.
Line 58, after "steel" insert -- is --.

Column 11,
Line 15, "to the two" should read -- to two --.
Line 19, "TABLE I" should read -- TABLE 1 --.
Line 57, after "superior to that" delete "of the".

Claims,
Column 12,
Line 23, "1541,3120,4118" should read -- 1541, 3120, 4118 --.
Line 24, "4337,4320" should read -- 4337, 4320 --.
Line 55, "4337,4320" should read -- 4337, 4320 --.

UNITED STATES PATENT AND TRADEMARK OFFICE

CERTIFICATE OF CORRECTION

PATENT NO. : 6,206,983 B1
DATED : March 27, 2001
INVENTOR(S) : Anhony J. DeArdo and C. Isaac Garcia It is certified that error appears in the above-identified patent and that said Letters Patent is hereby corrected as shown below:

Claims, cont'd,
Column 13,
Line 9, "4337,4320" should read -- 4337, 4320 --.
Line 28, "1040,1041" should read -- 1040, 1041 --.

Column 15,
Line 20, after "tin" delete "25".

Column 18,
Line 12, "claim 51" should read -- claim 50 --.
Line 13, "claim 52" should read -- claim 51 --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*